US005201122A

United States Patent [19]

Annunziata

[11] Patent Number: 5,201,122

[45] Date of Patent: Apr. 13, 1993

[54] AIM ASSIST DEVICE FOR A WEAPON

[76] Inventor: Mark J. Annunziata, 626 E. Rosner Dr., Roselle, Ill. 60172

[21] Appl. No.: 884,147

[22] Filed: May 18, 1992

[51] Int. Cl.[5] ..... F41G 1/467; F41G 1/32; G02B 23/10

[52] U.S. Cl. ..... 33/265; 33/241; 124/87

[58] Field of Search ..... 33/265, 233, 241, 245, 33/246, 262, 263, DIG. 21; 124/87, 86, 88

[56] References Cited

U.S. PATENT DOCUMENTS

| | | | |
|---|---|---|---|
| 2,596,522 | 5/1952 | Bethke | 33/241 |
| 3,526,037 | 9/1970 | Crosby | 33/265 |
| 3,667,444 | 6/1972 | Depatie et al. | 33/265 |
| 3,682,552 | 8/1972 | Hartman | 33/245 |
| 3,737,232 | 6/1973 | Milburn, Jr. | 33/245 |
| 3,938,875 | 2/1976 | Ruder | 33/233 |
| 4,294,017 | 10/1981 | Byrnes et al. | 33/265 |
| 4,606,629 | 8/1986 | Hines et al. | 33/265 |
| 4,665,622 | 5/1987 | Idan | 33/241 |
| 4,764,011 | 8/1988 | Goldstein | 33/241 |

*Primary Examiner*—William A. Cuchlinski, Jr.
*Assistant Examiner*—C. W. Fulton
*Attorney, Agent, or Firm*—Douglas B. White

[57] ABSTRACT

An aim assist device is described which consists of a light beam generator mounted to the weapon and positioned to direct the beam toward the eye of the operator. This beam is projected on a screen at the end of a tubular housing. When the weapon is properly held and aimed, the beam becomes visible and centered in the screen.

2 Claims, 2 Drawing Sheets

AIM ASSIST DEVICE FOR A WEAPON

BACKGROUND OF THE INVENTION

1. Field of the Invention

This invention relates generally to weapon sighting apparatus. More particularly this invention relates to a novel attachment to a weapon, such as a bow or rifle, to assist the operator in accurately using the weapon sights.

2. Description of the Prior Art

Weapon signts have generally suffered from a parallax problem which affects accuracy due to the unreliable positioning of the weapon relative to the operators eye. In the use of a bow this problem is compounded by an inconsistent pull of the bow string prior to arrow release.

SUMMARY OF THE INVENTION

Accordingly it is the principal objective of the present invention to provide an aim assist apparatus which removes the parallax problem and assures consistency in the positioning of the weapon prior to discharge of the projectile.

This aim assist device consists of a light beam generator mounted to the weapon and positioned to direct the beam toward the eye of the operator. This beam is projected on a screen at the end of a tubular housing; and when the weapon is properly held and aimed, the beam becomes visible and centered in the screen.

While the invention will be described in connection with a preferred embodiment, it will be understood that it is not the intent to limit the invention to that embodiment. On the contrary, it is the intent to cover all alternatives, modifications, and equivalents as may be included within the spirit and scope of the invention as defined by the appended claims.

DESCRIPTION OF THE PREFERRED EMBODIMENT

Figure 1:
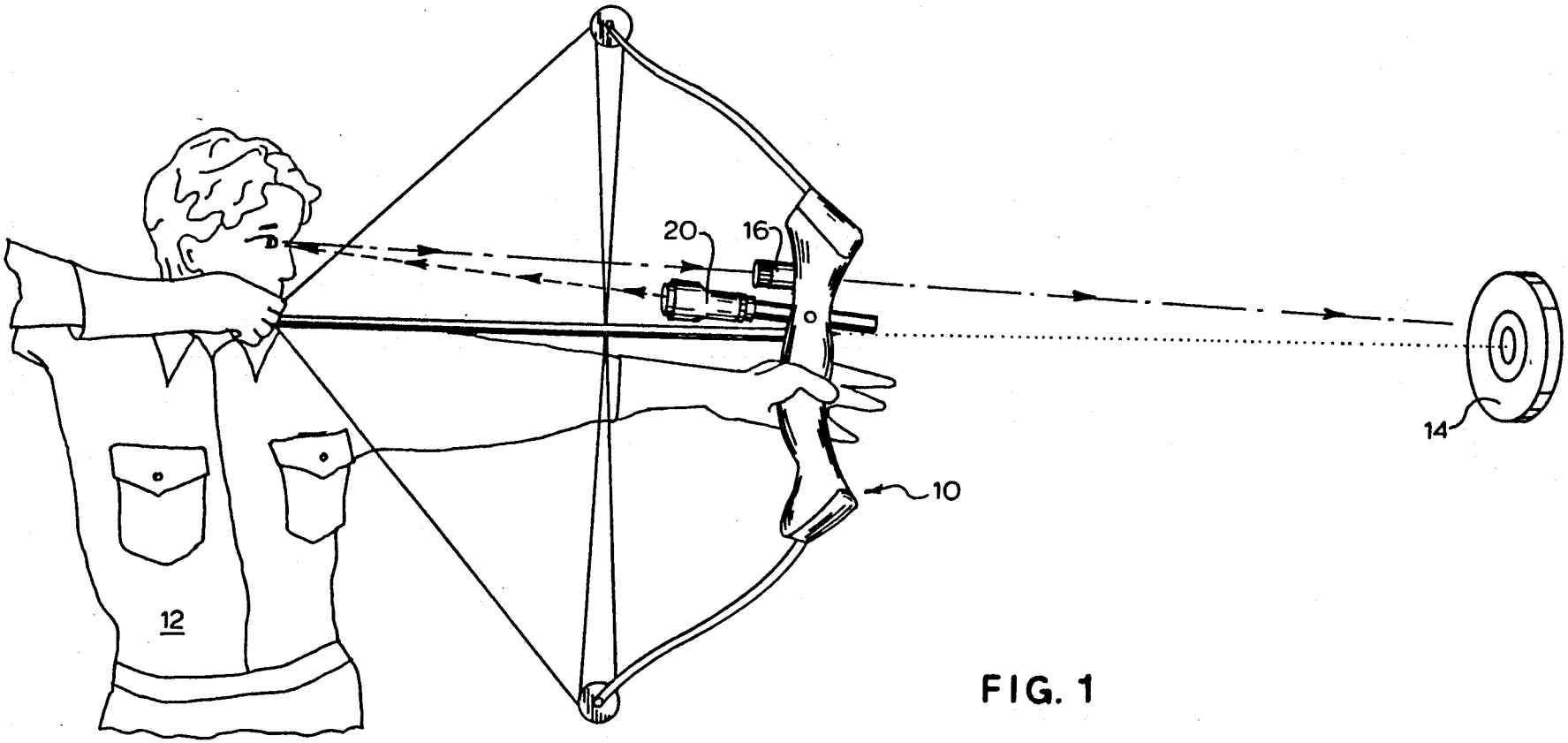
FIG. 1 is a perspective view of the aim assist device of the present invention as applied to a bow.

Turning to FIG. 1 there is shown a weapon 10 (which for purposes of discussion is depicted as a bow) and an operator 12. The bow is aimed at a target 14 through a traditional sighting device 16.

To assist the operator in accurately aiming the weapon, an aim assist device 20 is mounted to the weapon and is positioned to project a beam toward the eye of the operator only when the weapon is correctly positioned for discharge. This positioning is important to effectively use the weapon sights, and is critical in bow applications where the pull of the bow string affects the trajectory of the arrow.

Figure 2:
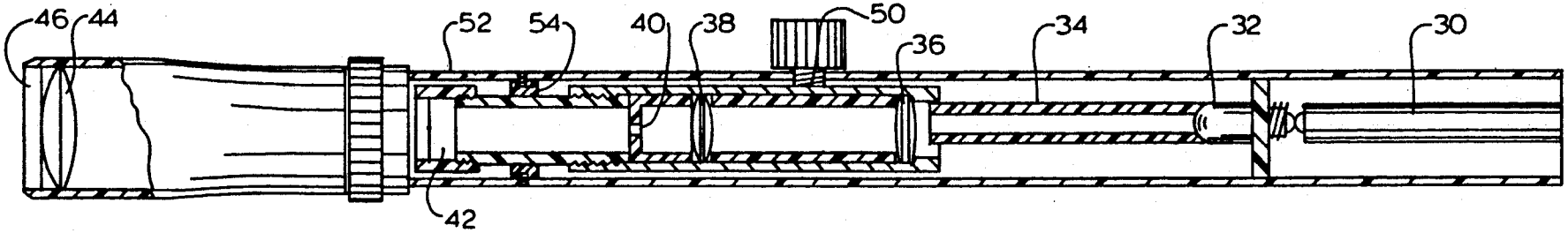
FIG. 2 is a partially cutaway and partially sectioned view of the device of FIG. 1.
Figure 3:
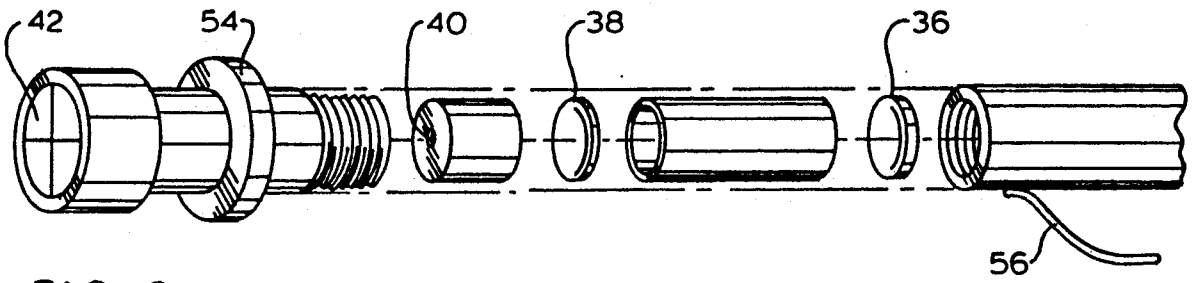
FIG. 3 is an exploded view of the beam columnating portion of FIG. 2.

The aim assist device of the present invention is shown in detail in FIGS. 2 and 3, and consists primarily of a light beam generator. A battery 30 operates a light 32 (or equivalent) which is columnated by use of a narrow tube 34, focusing lenses 36 and 38, and a small aperture 40. The resulting light beam is projected through a glass 42 having cross hairs to indicate the center. This beam and crosshair are then magnified through lens 44 and are visible through protective glass 46 only when the operator's eye is directly in line with the beam.

The main columnating section is shown in an exploded view of FIG. 3 to clarify the internal components. Moreover, this section is used to adjust the direction of the beam by use of dual screw posts 50. (Only one of such posts are shown, with the other positioned 90° therefrom.) This columnating section is mounted within the housing 52 by a collar 54 to allow minor angular adjustment by the screw posts, and this section is biased against the posts by a spring member 56.

After mounting this device to a weapon and after the sight of the weapon is adjusted to the target, this aim assist device is then adjusted by the screw posts until the light beam becomes visible at the center of the crosshairs when the weapon is properly sighted. Thereafter, when using the weapon, the operator's constant positioning of the weapon and of the operator's eye relative to the sight is assured whenever the light beam is visible at the center of the crosshair.

From the foregoing description, it will be apparent that modifications can be made to the apparatus and method for using same without departing from the teachings of the present invention. Accordingly, the scope of the invention is only to be limited as necessitated by the accompanying claims.

I claim:

1. Apparatus for attachment to a bow to assist the archer in achieving the proper position of the bow for use of the bow sight, said apparatus comprising:

light beam means for generating and columnating a beam of light, directed toward the archer, wherein said beam of light is visible only when the bow is positioned properly for the archer to use the bow sight; and means for mounting said light beam means to said bow at a location spaced from the line of sight of the aim of said bow.

2. The apparatus for attachment to a bow to assist in the aim of the bow of claim 1 further comprising adjustment means for controlling the visibility of said beam of light to allow the archer to optimize the visibility of said beam of light when said bow is held in a predetermined position relative to said archer.

* * * * *